US007481073B2

(12) United States Patent
Carlin et al.

(10) Patent No.: US 7,481,073 B2
(45) Date of Patent: Jan. 27, 2009

(54) SYSTEM AND APPARATUS FOR DELIVERING EXPANDED REFRIGERANT TO AN AIR/GAS DRYER

(75) Inventors: John A. Carlin, Buffalo, NY (US); David R. Arno, East Amherst, NY (US)

(73) Assignee: Parker-Hannilin Corporation

( * ) Notice: Subject to any disclaimer, the term of this patent is extended or adjusted under 35 U.S.C. 154(b) by 371 days.

(21) Appl. No.: 11/082,110

(22) Filed: Mar. 15, 2005

(65) Prior Publication Data

US 2005/0198977 A1 Sep. 15, 2005

Related U.S. Application Data

(60) Provisional application No. 60/553,052, filed on Mar. 15, 2004.

(51) Int. Cl.
*F25B 13/00* (2006.01)

(52) U.S. Cl. ..... 62/324.6

(58) Field of Classification Search ..... 62/200, 62/198, 205, 225, 527, 126, 324.6, 224, 498; 137/814, 505.12
See application file for complete search history.

(56) References Cited

U.S. PATENT DOCUMENTS 4,593,123 A * 6/1986 Matsuda ..... 62/199
4,878,357 A * 11/1989 Sekigami et al. ..... 62/160
4,942,740 A * 7/1990 Shaw et al. ..... 62/93
RE33,775 E 12/1991 Behr
5,749,238 A * 5/1998 Schmidt ..... 62/211
6,490,877 B2 12/2002 Bash
6,516,626 B2 2/2003 Escobar
2003/0070441 A1 * 4/2003 Moon et al. ..... 62/225

FOREIGN PATENT DOCUMENTS

JP 05133618 A * 5/1993

* cited by examiner

*Primary Examiner*—Mohammad M Ali
(74) *Attorney, Agent, or Firm*—Kloss, Stenger & Lotempio; Vincent G. Lotempio

(57) ABSTRACT

The present invention relates to a method and apparatus for effectively reducing/eliminating oscillation of over and under shoot of superheat and refrigerant feed in an evaporator of compressed refrigerant of a gas/air dryer system. The feed makes use of a plurality of refrigerant expansion valves, sized in scaled manner, and adjusted inversely to the size of each, affording exact feed requirements to the evaporating vessel heat exchange. The system uses superheat feedback to respond rapidly or slowly to fill need for large or modest injections leading to stable, balanced operations. The operations 'level-out' to a smooth, even output of the gas/air dryer dew point temperature, relatively close to the dew point seat point without falling into an endless loop oscillation. The feed delivery of staged injection meters expanded refrigerant to demand while tracking superheat.

12 Claims, 4 Drawing Sheets

SYSTEM AND APPARATUS FOR DELIVERING EXPANDED REFRIGERANT TO AN AIR/GAS DRYER

This application claims priority of U.S. Provisional Patent Application 60/553,052 filed on to the Mar. 15, 2004, titled: STAGED INJECTION PROCESS FOR REFRIGERATED COMPRESSED GAS/AIR DRYERS AND METHOD THEREFORE.

BACKGROUND OF THE INVENTION

1. Field of the Invention

The present invention relates to the field of refrigerant, compressed gas/air dryer systems, and more particular to a refrigerant 'feed' process employing multiple staged expansion valve injection inputs affording significant system stability and effectiveness.

2. Background

Presently, many industrial applications using air or gas driven machinery have a need for dry air or gas in the process of operating, product process, product fabrication, as well as many other applications. Air or gas driven machinery is most commonly operated using pressurized, i.e., compressed air or gas that contains water that can react on or condense within product or apparatus and negatively impact the air or gas usefulness. When compressed the partial pressure of water will increase as the volume decreases. Moisture in the form of condensation or precipitation in machinery or on product negatively impacts the product process systems by causing costly equipment maintenance or equipment failure and befouled product.

Refrigerant dryers are the most common devices to remove moisture from compressed air or gas for such industrial uses, thus reducing failures and improving product quality. The water content quality of the air or gas being dried, at the dryer's output is measured in terms of dew point, the temperature where water vapor in the air or gas is at 100% humidity; the lower the dew point temperature, the greater the dryness of the air or gas. Dryer air or gas is considered higher quality. Industry desires air or gas of sufficient quality to prevent water from damaging machinery or fouling product.

There are several types of refrigerant air or gas dryers, the following list includes more conventional systems: Cycling Dryers, Non-Cycling Dryers and Variable Speed Drive Dryers. In general, refrigerant air or gas dryers have: 1) a refrigerant compressor (with an appropriate accumulator and receiver); 2) a series of heat exchanger vessels and/or other 'heat' transfer components; 3) a condensing component; and a 4) a refrigerant process controller having one or more of the following: expansion, pressure regulating, bypass valves; solenoids and electronic sensors/controls; an optional variable speed drive (VSD) system for the compressor motor.

These systems all operate on various levels of efficiency, both with respect to cost and dew point performance. In common practice, a cycling air or gas dryer includes an unloading feature that to allows the compressor motor to power down, i.e., to coast or free wheel during periods of low demand for refrigerant cooling. Thus, a cycling dryer is considered an energy savings dryer when compared to a conventional non-cycling system. Another example of energy savings may be found in a system configured with a variable speed drive (VSD) device to decrease power to or to slowdown the compressor during lull intervals, periods of less demand for refrigerant cooling. Such a system is also considered to be an energy savings dryer because the compressor consumes less energy during the lull intervals.

However, each of these above listed devices use an expansion valve to feed or deliver compressed refrigerant into a heat exchange type vessel, where the expansion of refrigerant produces a coldest point for heat exchange purposes. Expansion valves rely on a temperature and pressure feedback which causes the valve opening to either increase in size for greater refrigerant feed, or, decrease in size for less refrigerant feed. These valves are conventionally available as strictly mechanical valves or in combinations of mechanical and electrical and/or electronic (solenoid, proportional, step motor drive, etc. with or without microprocessor control) valves; all having the desired goal to feed expanded refrigerant as required by the recycling means back to the refrigerant side of a heat exchanger providing a coldest point for thermal exchange.

One of the problems in this type of device is that the expansion valves are called-out in terms of tonnage (the capacity with which the device can deliver expanded refrigerant and feed the system). The tonnage is expressed as a range based on differential pressure; for example, 10 tons (generally for operating in systems from about 80,000 btus to about 120,000 btus capacity requirements). When these devices are specified in the design of a system, the tonnage expressed could actually be implemented as on the low side, in the mid range, or, on the high side of the valve capability to deliver refrigerant feed. This means, in simple terms, that the valve in any particular system may be required to work near maximum capacity, in a mid range, or barely working efficiently at low capacity, each, respectively in each design. That equates, in each of the scenarios, to the valve working less than ideal for most of the range of the system designs capacities.

To broaden the range of efficient operation of the valves used in varied systems, the expansion valve is conventionally adjusted. The adjustment is expressed in terms of superheat; a value derivative equivalent to the refrigerant systems compressor suction pressure converted to degrees in temperature (as related to a specific refrigerant type) and subtracted from the refrigerant systems suction temperature.

An expansion valve may be generally used over a wide tonnage range. Thus factory adjustment for superheat is undesired. Each valve must be set for superheat to reflect 10-15° F. over room temperature. To set the superheat, one must use a thermocouple or thermometer to measure the temperature of the suction line, for example, at a thermal bulb. Then one measures the pressure in the suction line at the thermal bulb well or external equalizer. The measured suction is then converted to a pressure equivalent saturated temperature using a pressure temperature chart. The difference between this value and the temperature measured at the thermal bulb well is expressed as the superheat. Superheat is often in the approximate range of five to ten degrees F.

Ideally, the superheat (a value derived from suction temperature and suction pressure), gives feedback to the expansion valve to close-down (a call for less refrigerant) to maintain a predetermined level of performance. Conversely, when the call is to increase refrigeration, the change in superheat causes the expansion valve to open-up and feed more expanded refrigerant.

Unfortunately, no valve devices work at an optimum under most or all conditions in any given system or design. In practice the parameters routinely overshoot. The result is an expansion valve hunting endlessly. That is the valve will open-up for more feed which will be followed by a close-down because of too much feed, and again, an open-up because of too little feed resulting in a drop of the flooding level; resulting in a never ending cycle. This phenomenon occurs in every system at some point even in carefully designed systems using the mid range as ideal or with sophisticated electronically assisted expansion valve devices. This hunting, over/under, constant pursuit to satisfy the endless loop of superheat feedback results in less than ideal performance of the gas/air dryer system desired to produce a low, constant dew point temperature gas or air. The hunting results from the refrigerant being returned in an erratic manner.

Another problem with conventional refrigerated compressed air dryers systems is when the refrigerant causes 'freeze-up' of the heat exchanger system because the expansion valve is opened too much or for too long a period of time and conversely, when the expansion valve opening is closed too much or for too long, the gas/air dryer system would suffer poor performance with respect to dew point.

Various patented devices have been designed to overcome poor performance with respect to dew point. U.S. Pat. No. 6,516,626 (Escobar) discloses a two stage refrigeration system incorporating a means for storing refrigerant vapor and slurry having a receiving tank or tanks. U.S. Pat. No. 6,490,877 (Bash) teaches parallel evaporators and a means to control the mass flow rate of the refrigerant to each evaporator. U.S. Reissue Pat. No. RE 33,775 (Behr) teaches the use of multiple evaporators and method of controlling the valve in a refrigeration system. However, the various systems are undesirable in that they do not provide a means for staged feed injection of to deliver refrigerant to a single evaporator system and process to maintain stable, balanced parameters affording a very high performance in dew point of a gas/air dryer system. These inventions suffer from the fact that they do not provide for smaller capacity adjusted to the 'higher' end of their ranges while the larger capacity is set to their 'lower' end of adjustment process. Also, these inventions do not adequately track the demand for refrigerant and thus fail to modestly modulate the valve to result in perfect output of dew point temperature according to the gas/air dryer's capacity.

Thus the state of the art is clearly not ideal. Normal load changes during industrial cycles can adversely affect dryer operations, resulting in poor dew point performance, waste of energy and wear-and-tear of equipment. The industry has accepted that it is the nature of refrigerated gas/air dryer systems (even those having sophisticated electronically assisted expansion valves) to function with cyclical operation expansion and thus routinely experience the same over/under performance.

Thus it is readily apparent that there is a longfelt need for structure and process such as a plurality of refrigerant expansion valves where "staged" feed is injected into the refrigerant side of the evaporator heat exchanger to affect a more controlled means to 'deliver' the expanded refrigerant into the heat exchange to maintain stable, balanced parameters affording a very high performance in dew point of a gas/air dryer system.

SUMMARY OF THE INVENTION

The present invention comprises a plurality of expansion valves that operate to precisely feed expanded refrigerant according to demand, thereby reducing overshoot and undershoot resultant hunting.

It is a general object of the present invention to provide an improved process to feed refrigerant to an evaporator of an air or gas dryer apparatus using a plurality of expansion valves, either singularly or in combination, to satisfy the required 'superheat' call in such a manner that stabilizes, gives balance and results in the best possible dew point performance.

Another object of the present invention is to deliver metered feed of expanded refrigerant that allows full capacity when needed (when demand is great), moderate feed as requirements call for less, and uniquely, a 'vernier' to trim the need for any demand to an exact feed injection.

Yet another object of the present invention is to provide a 'scaled' approach to eliminating the 'hunting' manifestation that is prevalent in conventional refrigerant expansion techniques.

Still another object of the present invention is to utilize multiple 'tonnage' sizes of expansion devices, adjusted with each stage 'inversely' to its expansion capacity; with the smaller capacity set to the 'higher' end of range, while the larger capacity set to the 'lower' end of range.

An object of the present invention is to improve the conventional art with a method for drying air or gas using a plurality of refrigerant feed injection valves that independently respond to demand in situations of increased need as well as demand in situations of reduced need. Preferably the response varies in rate to reduce or eliminate hunting and over/under shoot with respect to superheat feedback.

A preferred aspect of the present invention features a multistage system and apparatus for delivering expanded refrigerant to an air/gas dryer device. The multistaged system preferably includes a plurality or combination of refrigerant feed injection valves having at least a first stage and a second stage with each stage of the combination receiving superheat inputs and adjusting valve position in response to the superheat inputs.

Another preferred aspect of the present invention features a first and a second stage, the two stages having a first output capacity that can be expressed as tonnage and a second output, respectively, the first output having a different capacity than the second output. Preferably the first output has a capacity at least about 2 times capacity of the second output. Other embodiments include capacity ratios of about 4 times, 5 times, 6 or 8 times capacity of a first to a second output. There may be, for example, a third output in addition to the first and second outputs. The third output may have a difference of about 5 times a capacity of said second output. A particularly preferred embodiment features a first output about or between 2 to three times the capacity of the second output.

A preferred aspect features a first output set at about 20 to 50% of system capacity and a second output set at about 60 to 95% of system capacity. A third, fourth, fifth, sixth, etc. stage with respective output may be present. In one aspect the system and apparatus has a plurality of stages each with a respective output of at least two times a capacity of another stage respective output capacity. In one aspect the system and apparatus has a plurality of stages each with a respective output at least two times a capacity of another stage respective output capacity.

Especially preferred systems and apparatus of the present invention feature a second output capacity larger than the first output capacity; a third output capacity if present larger than the second output capacity; a fourth output capacity if present larger than the third output capacity; a fifth output capacity if present larger than the fourth output capacity; and a sixth output capacity if present larger than the fifth output capacity. Preferably the largest output capacity does not exceed a maximum size tonnage determined for any given system or application.

In an especially preferred embodiment, the system and apparatus of the present invention comprise a total number of stages x, wherein said first stage has a capacity about 1/x the capacity of stage x; the second stage has a capacity about 1/x−1; the third stage if present has a capacity about 1/x−2;

the fourth stage if present has a capacity about 1/x−3; the fifth stage if present has a capacity about 1/x−4; to an x−1th stage having a capacity about ½ the capacity of stage x.

According to the present invention refrigerant feed injection valves preferably function to provide stable performance in at least one parameter selected from the group consisting of dew point, suction pressure, suction temperature and superheat. Most preferably dew point fluctuates less than 0.2° F. over a period at least one hour.

A method aspect of the present invention features treating compressed air or gas comprising activating a plurality of refrigerant feed injection valves to reduce or eliminate hunting and over/under shoot with respect to superheat feedback.

In the preferred embodiment, with three stages, the tonnage selection for the first stage expansion valve, of any given system specifications could be, for example, one quarter of the total tonnage requirement. The next stage could be half the size of the total system need with respect to tonnage. And the final stage, in this example, would be an expansion valve selection equal to the full tonnage required to process the call for refrigerant. In such a system configuration, each of the expansion valve stages would be adjusted according to the number total stages comprising the injection system. Again for example, the present invention teaches that the first stage valve (the one quarter sized), would be set to deliver expanded refrigerant at the 'higher' end of the adjustment range. The half sized valve, in this arrangement may be left at its mid range delivery for expanded refrigerant, while, the final stage (full capacity sized expansion valve) would be adjusted to the 'lower' delivery range. The system now can deliver 'metered' feed of expanded refrigerant.

A further object of the present invention is to provide an improved process to feed refrigerant to an evaporator of an air or gas dryer apparatus to 'flatten' the operating parameters to stable measurement values.

These and other objects, features, aspects and advantages of the present invention will become apparent upon a reading of the detailed description and claims in view of the several drawing figures.

DETAILED DESCRIPTION OF THE INVENTION

Figure 1A:
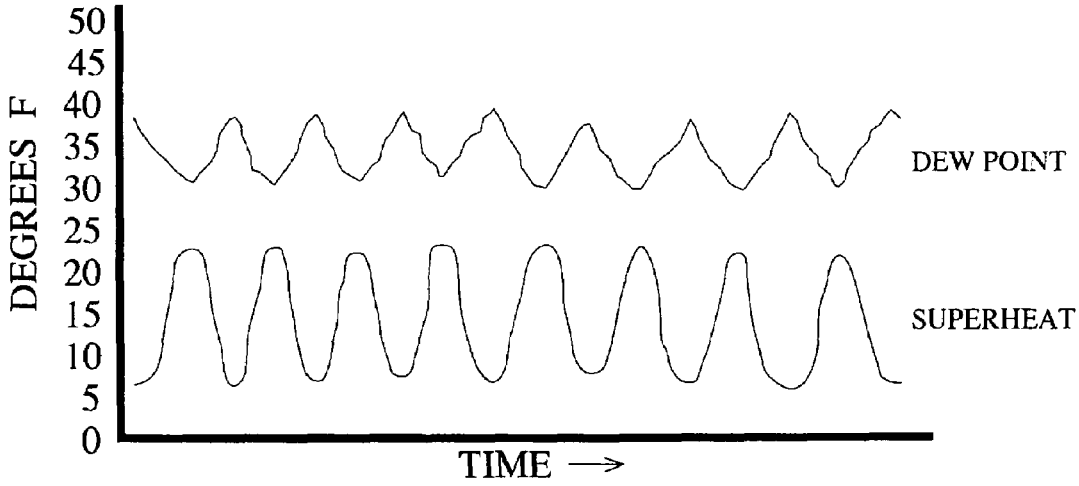
(PRIOR ART) FIG. 1A
FIG. 1A is a graph showing data logged from a conventional refrigerant air/gas dryer system indicating the oscillation of dew point and superheat.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

The present invention relates to a method and apparatus for effectively reducing/eliminating oscillation of over and under shoot of superheat and refrigerant feed in an evaporator of compressed refrigerant of a gas/air dryer system. The feed makes use of a plurality of refrigerant expansion valves, sized in scaled manner, and adjusted inversely to the size of each, affording exact feed requirements to the evaporating vessel heat exchange. The system uses superheat feedback to respond rapidly or slowly to fill need for large or modest injections leading to stable, balanced operations. The operations 'level-out' to a smooth, even output of the gas/air dryer dew point temperature, relatively close to the dew point seat point without falling into an endless loop oscillation. The feed delivery of staged injection meters expanded refrigerant to demand while tracking superheat.

Figure 1B:
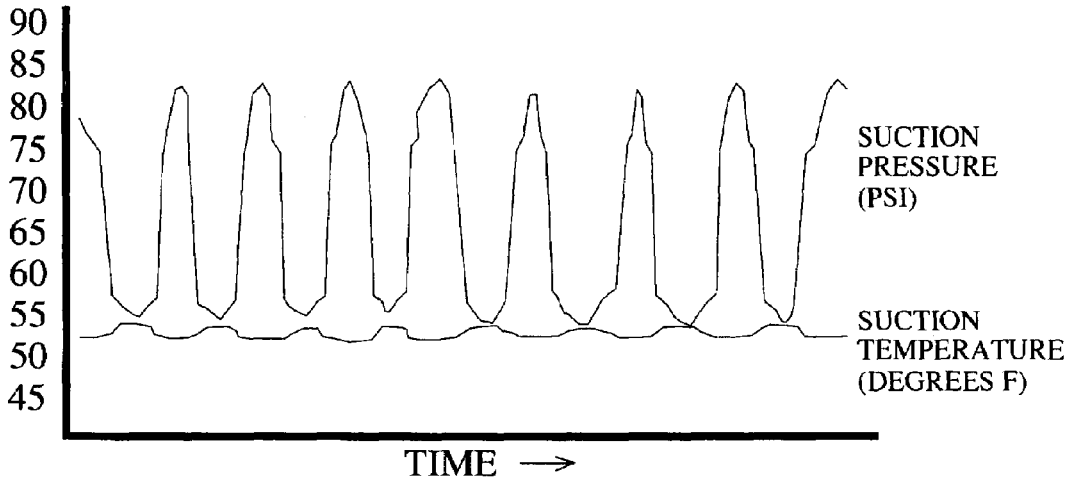
(PRIOR ART) FIG. 1B
FIG. 1B is a graph showing data logged from a conventional refrigerant air/gas dryer system indicating the oscillation suction pressure and suction temperature.

Adverting now to the drawings, FIGS. 1 (A & B) show data logged from a conventional art refrigerant air/gas dryer system not incorporating the present invention. The data clearly shows that the parameters oscillate in the attempt to satisfy the call for refrigerant, and giving unstable poor performance.

Figure 2A:
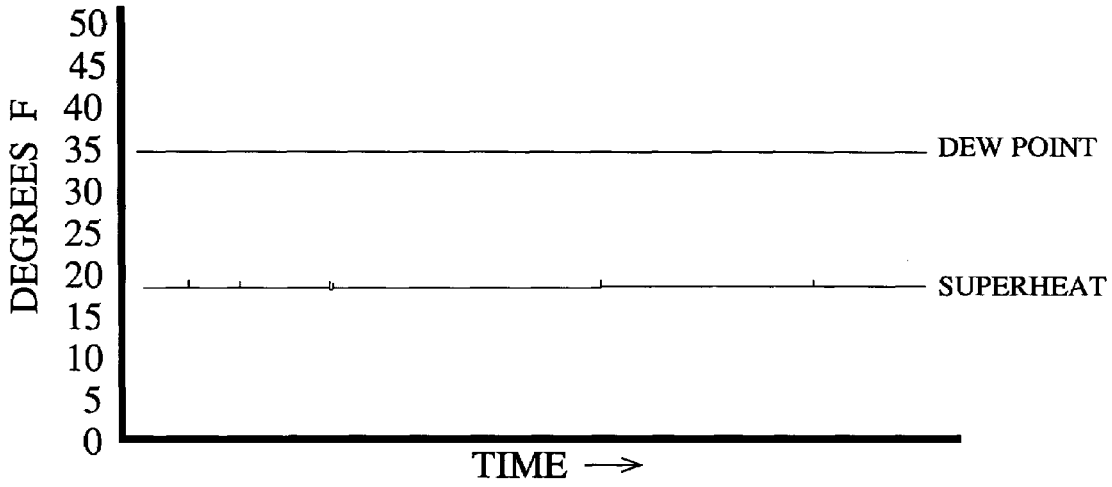
FIG. 2A is a graph showing data logged from a refrigerant air/gas dryer system incorporating the present invention depicting the stable and balanced measurements of dew point and superheat.

FIGS. 2 (A & B) shows data logged from a refrigerant air/gas dryer system equipped with the system of the present invention, showing its parameters fully satisfied at the call for refrigerant, and giving stable, balance performance. The system of the present invention 'stabilizes' all to a 'level' of balance. The present invention provides a 'scaled' approach to eliminate the 'hunting' manifestation that is prevalent in conventional refrigerant expansion techniques. The stages in the present invention each preferably operate independently and give their particular expansion capacity when needed to satisfy the superheat call for refrigerant. The system never suffers the 'over/under' adverse effects of gas/air dryers system with just a single expansion valve.

The staged injection of expanded refrigerant, of the present invention, allows full feed capacity when needed (when demands are great), moderate feed when as requirement call for less, and uniquely, a 'vernier' to trim the need for any demand to exact feed requirement. This 'scaled' approach affords stability to a system that conventionally is inherent to 'hunt'. The result is substantially flat-lined parameters. Without the staged injection of expanded refrigerant, of the present invention, the superheat continually scales too high (and overshoots) then too low (and overshoots), because of the demand (load on the gas/air dryer). This demand causes the refrigerant expansion valve opening to expand too wide to compensate for the demand, and once demand is more than met, then contact too much, resulting in the dew point to be above the set point (then followed by it being below the set point) causing an unbalanced continual hunting response.

The staged injection of expanded refrigerant, of the present invention, can deliver more than what is required and can do it faster because of multiple line feeding. Yet is exact when just a small amount of feed is required to 'trim'. The system has the capability to respond to varying demands by quickly activating capacity stages, thereby, reducing the chance and cause of oscillation and 'wildly swinging' dew point. These parameters, which are all interrelated, flatten and the dew point would find the set point value and remain there. The superheat thus responds to demand changes instead of just responding to the peaks and valleys of the hunting expansion valve oscillations and the expansion valve(s) no longer oscillate due to erratic superheat response. The system 'seeks' its balance, finding the 'rhythm' of its own beat resulting in stable measurement values of the operating parameters data as shown in FIGS. 2 A & B. The system clearly eliminates the peaks and valleys of oscillations (as depicted in FIGS. 1 A & B) caused in the conventional expansion process. The present invention tracks the demand and modestly modulates always giving perfect dew point temperature according to the air/gas dryer's capacity. For example the dew point may vary less than 0.5° F., preferably less than 0.4° F., more preferably less than 0.3° F., still more preferably less than 0.2° F., and most preferably less than 0.1° F., over a period of time preferably in excess of one minute, more preferably in excess of one hour, still more preferably in excess of a plurality of hours, for example, 2, 3, 4, 5, 6, 7, 8, 9, 10, 12, 15, 16, 20, 24, 36, 48, 60, 72, 96 or more hours.

Figure 3:
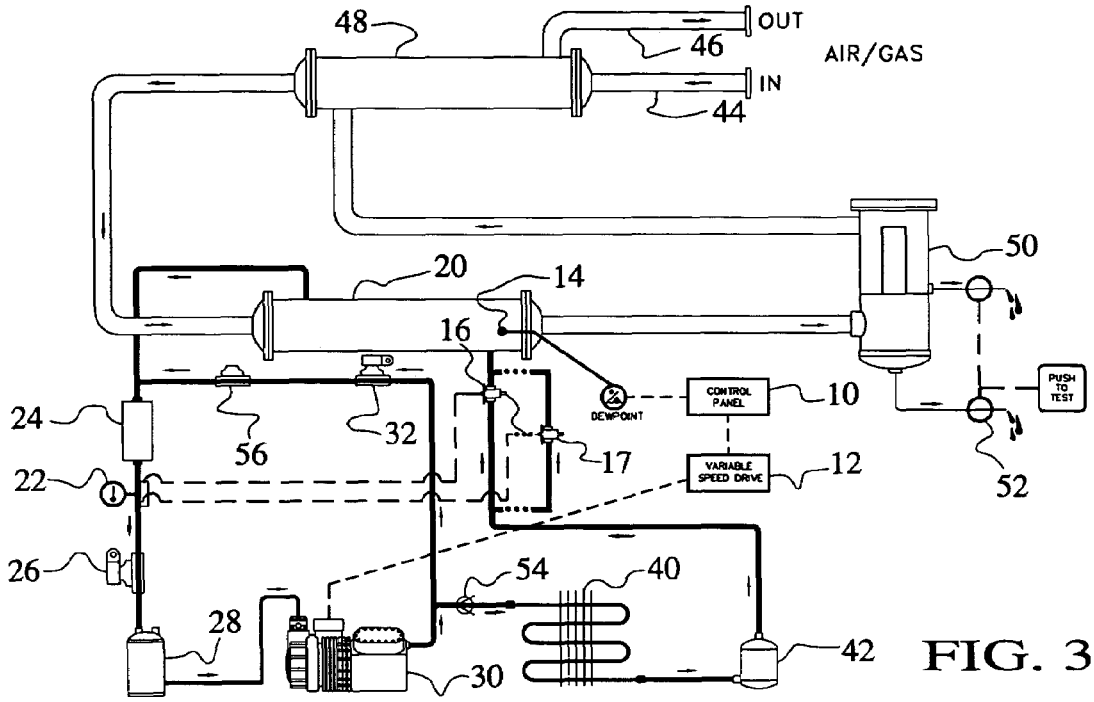
FIG. 3 is an illustration showing a Cycling refrigerant air/gas dryer system used in combination with Variable Speed Drive and the staged injection of the present invention is implemented using multiple expansion valves of multiple sizes and arrangements.
Figure 4:
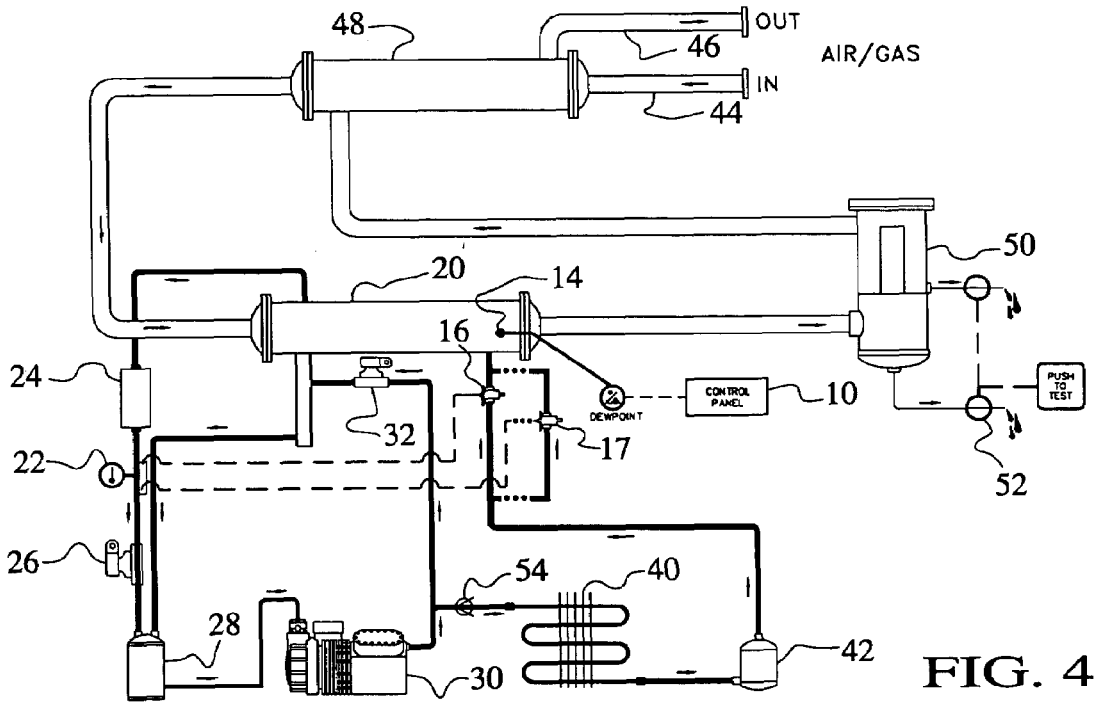
FIG. 4 is an illustration showing a Cycling refrigerant air/gas dryer system of an alternate embodiment of the present invention where staged injection is implemented using multiple expansion valves of multiple sizes and arrangements.
Figure 5:
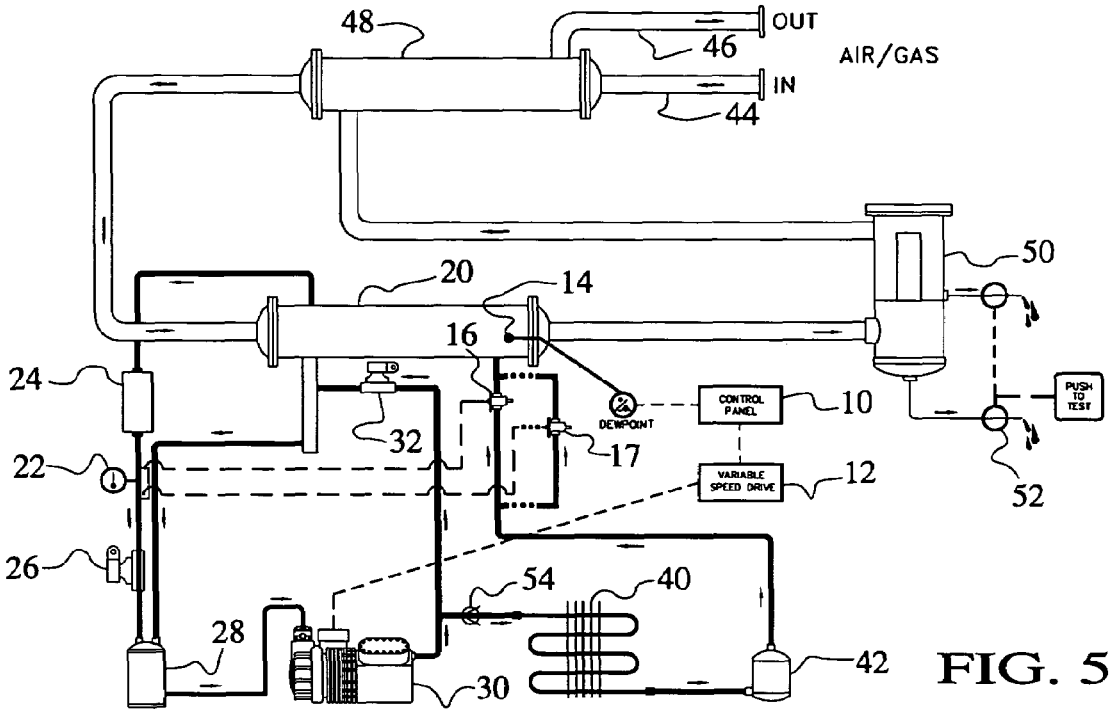
FIG. 5 is an illustration of an alternate embodiment of the present invention showing of a Cycling refrigerant air/gas dryer system used in combination with Variable Speed Drive and staged injection is implemented using multiple expansion valves of multiple sizes and arrangement.

In general, FIGS. 3-5 depict refrigerant air or gas dryers having control panel 10 used in combination with refrigerant compressor 30, suction accumulator 28, liquid receiver 42, a series of heat exchanger vessels such as precooler/reheater 48, evaporator 20 and separator coalescing filter 50. The system also has a condensing component refrigerant condenser 40, dew point probe 14, unloader valve 32, expansion valve stages 16, 17 and 18, check valve 54, superheat 22, suction line solenoid 26, air/gas input 44, air/gas output 46, flood level control 24, drain 52 variable speed drive (VSD 12) system regulating the compressor motor.

Figure 2B:
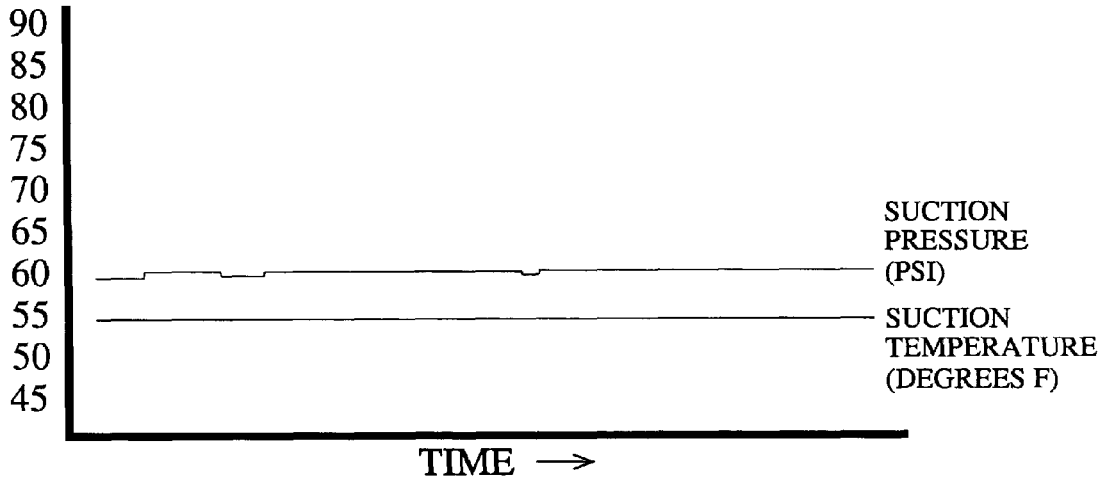
FIG. 2B is a graph showing data logged from a refrigerant air/gas dryer system incorporating the present invention depicting the stable and balanced measurements of suction pressure and suction temperature.

FIG. 3 is an illustration showing a Cycling refrigerant air/gas dryer system used in combination with Variable Speed Drive where the staged injection of the present invention is implemented using expansion valve sages 16 and 17 of multiple sizes and arrangements. Expansion valve stages 16 and 17 are used in such a manner to feed the system, either singularly or in combination, to satisfy the required superheat call for refrigerant. The graph shown in FIG. 2B is a compilation of data logged from refrigerant air/gas dryer system incorporating the present invention as shown in FIG. 3. The data demonstrates that where the staged injection of the present invention is implemented using multiple expansion valves of multiple sizes and arrangements the result is stable and balanced measurements of suction pressure and suction temperature.

Figure 6:
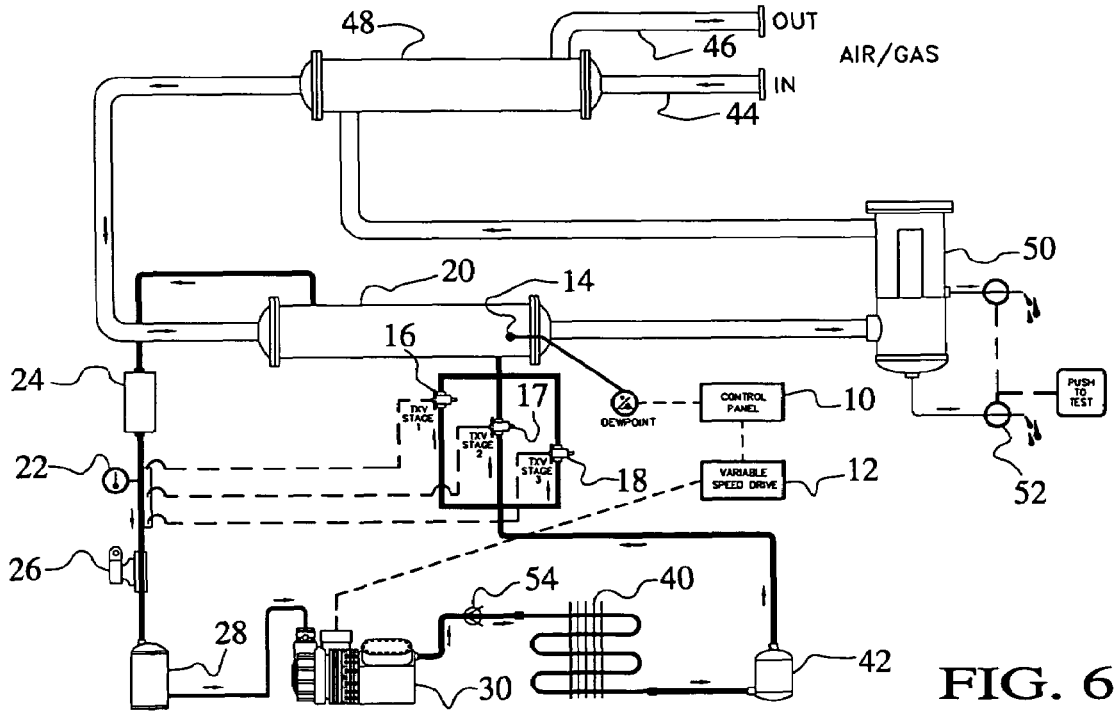
FIG. 6 is an illustration showing another embodiment of the present invention wherein a Non-Cycling refrigerant air/gas dryer system is used with a Variable Speed Drive wherein staged injection is implemented using multiple expansion valves of multiple sizes and arrangements.

FIG. 6 is an illustration depicting a preferred embodiment of the present invention featuring a non-cycling system equipped with a three staged expansion process. Three valve stages 16, 17 and 18 each have a superheat 22 input. In this embodiment, preferably first stage 16 has a tonnage about one quarter to one third design tonnage for the system size assuming a single stage. Second stage 17 has a tonnage about one half to two thirds tonnage for the system size assuming a single stage. While third stage 18 has a tonnage about 100% tonnage for the system size assuming a single stage required to process the call for refrigerant.

FIG. 5 is an illustration of a second alternate embodiment of the present invention showing of a Cycling refrigerant air/gas dryer system used in combination with Variable Speed Drive where staged injection is implemented using expansion valve stages 16 and 17 of multiple sizes. This embodiment employs a cycling hot gas valve arrangement 56 a pressure regulating valve. In this system the cycling hot gas valve arrangement works in combination with variable speed drive 12 which automatically regulates the flow by opening and closing the unloader. This system is mainly used in very large units.

FIG. 4 is an illustration showing another embodiment of the present invention wherein a Cycling refrigerant air/gas dryer system is used without a Variable Speed Drive where the staged injection is implemented using multiple expansion valves of multiple sizes and arrangements.

The preferred embodiment of the present invention provides structure and process to affect a controlled means to 'deliver' the expanded, compressed refrigerant into the heat exchanger. The present invention has 'staged' feed to overcome the adverse effects of a conventional refrigerant air/gas dryer system, where the constant over/under feed process is an inherent problem. The staged feed is injected into the refrigerant side of evaporator heat exchanger 20. A plurality of refrigerant expansion valves (expansion valve stages 16 and 17) are used in such a manner to feed the system, either singularly or in combination, to satisfy the required superheat call for refrigerant. Each staged injection feed of compressed refrigerant, is a graduated step. The whole of all staged steps, comprise the injection process of the present invention. The result is a fully controlled 'vernier' feed.

An example of the preferred embodiment how staged feed is injected into the refrigerant side of the evaporator heat exchanger of any given system specifications is as follows: the tonnage selection for the first stage expansion valve is one quarter of the total tonnage requirement. The next stage is half the size of the total system needed with respect to tonnage. And the final stage, in this example, is an expansion valve selection equal to the full tonnage required to process the call for refrigerant. In such a system configuration, each of the expansion valve stages is adjusted according to the number total stages comprising the injection system. The first stage valve (the one quarter sized), is set to deliver expanded refrigerant at the 'higher' end of the adjustment range. The half sized valve, in this arrangement is left at its mid range delivery for expanded refrigerant, while, the final stage (full capacity sized expansion valve) is adjusted to the 'lower' delivery range. The system configured as such can deliver 'metered' feed of expanded refrigerant.

Each stage, in this example of the preferred embodiment, has its superheat feedback 'bulb' (sensing refrigerant temperature), all located in the same location. For calls where the demand is great, all of the stages attempt to deliver expanded refrigerant. Because the largest sized valve is set to its lower adjustment, it can not satisfy the system independently. But with the support of the other stage(s), it can deliver more than what is required and can do it faster because of the multiple feeding lines.

To continue the scenario, as the call for refrigerant is satisfied, the system of the present invention would throttle back the feed. As the superheat approaches the range for more feed again, the stage(s) would respond appropriately; feeding just enough to bring the superheat to the region of being satisfied. Because each of the stages can operate independently and give its particular expansion capacity, the system never suffers the over/under adverse effects of gas/air dryer systems not configured as such.

Another embodiment of the present has two stages. In such a configuration, the first stage is set to accept a specific range of tonnage (somewhere between a third of the total tonnage and a half of the total tonnage) while the second stage is set at the full tonnage size required. In this scenario the first stage is adjusted with the setting at it 'higher' range. And the second full sized expansion valve is set to its 'lower' range.

Yet another embodiment employs four stages, or still another five stages; each progressively larger to a maximum size tonnage for any given application (not shown). Again each would be adjusted to give inversely an expansion output to its stage, in the system. That is, the smaller capacity is adjusted to the 'higher' end of its range while the larger capacity is set to its 'lower' end of adjustment. It should be understood to those skilled in the art, that the present invention could employ any number of expansion stages and further each could be comprised of any combination of tonnage sizes; all combining to inject exact refrigerant to afford stable gas/air dryer dew point. It should be understood that a system and apparatus of the invention may include one or more stages in addition to those claimed, for example, a stage not specifically mentioned in a specific claim may be present but have a capacity or other feature outside bounds for stages recited in that claim. For example, a system may include a first and a second stage, the first having a tonnage about one third that of the second stage; yet the system and apparatus may also include a non-recited stage, for example an additional stage having about one third that of the second stage.

It should also be understood that the present invention can be configured to any refrigerant gas/air dryer such as a system employing an unloader, a cycling or non cycling dryer, or even in combination with a variable speed driven refrigerant compressor. Further, any compressed air/gas drying system using multiple expansion valves configured with staged injection of present invention can use any type of refrigerant expansion valve, such as but not limited to a mechanical valve or electromechanical valve or a combination of valves. Thus it is seen that the present invention will enhance any compressed air/gas drying system with stable, balanced operation allowing a 'true' flat-line dew point output of the system. The values provided above are for reference purposes only. It should be understood other combinations of values are also possible.

It will be understood that the foregoing description is illustrative of the invention and should not be considered as limiting and that other embodiments of the invention are possible without departing from the invention's spirit and scope. It is also to be understood that the following claims are intended to cover all the generic and specific features of the invention herein described, and all statements of the scope of the invention that, as a matter of language, might be said to fall therebetween.

What is claimed is:

1. A multistage valve system for delivering expanded refrigerant to an air/gas dryer device comprising:

a multistage parallel combination of conventional mechanical refrigerant feed injection valves having at least a first stage and a second stage, each stage receiving superheat inputs wherein said first stage has a first output capacity that is at least about two times a capacity of a second output capacity of said second stage, and wherein said first stage has a first output valve position set in response to said superheat input and said second stage has a second output valve position set in response to said superheat input, respectively, and wherein said first output capacity of said first stage is 85 to 90% of the refrigerant capacity needed for the entire valve system and, said output capacity of said second stage is 20 to 25% of the refrigerant capacity needed for the entire valve system; and wherein said first output valve position is set at a lower superheat setting than said second output valve position such that as the capacity of said first stage is exceeded, the superheat will rise to the setting of the second stage causing the second stage to make-up the remaining capacity needed for the entire valve system.

2. The multistage valve system according to claim 1, wherein said first output has a capacity at least about 4 times a capacity of said second output.

3. The multistage valve system according to claim 1, wherein said first output has a capacity at least about 5 times a capacity of said second output.

4. The multistage valve system according to claim 1, wherein said first output has a capacity at least about 8 times a capacity of said second output.

5. The multistage valve system according to claim 1, wherein said first output has a capacity about 2 to 3 times a capacity of said second output.

6. The multistage valve system according to claim 1, further comprising at least a third stage having a third respective output.

7. The multistage valve system according to claim 6, further comprising at least a fourth stage having a fourth respective output.

8. The multistage valve system according to claim 7, further comprising at least a fifth stage having a fifth respective output.

9. The multistage valve system according to claim 8, further comprising at least a sixth stage having a sixth respective output.

10. The multistage valve system according to claim 1, wherein the second output capacity is larger than the first output capacity; and wherein a third stage has a third output capacity, a fourth stage has a fourth output capacity, a fifth stage has a fifth output capacity, and a sixth stage has a sixth output capacity, respectively; and wherein the third output capacity is larger than the second output capacity; the fourth output capacity is larger than the third output capacity; the fifth output capacity is larger than the fourth output capacity; and the sixth output capacity is larger than the fifth output capacity.

11. The multistage valve system according to claim 1, wherein each successive stage is progressively larger and the largest stage does not exceeding a maximum size tonnage determined for any given application.

12. The multistage valve system according to claim 1, comprising a total number of stages x, wherein said first stage has a capacity about 1/x the capacity of stage x; the second stage has a capacity about 1/x−1; the third stage has a capacity about 1/x−2; the fourth stage has a capacity about 1/x−3; the fifth stage has a capacity about 1/x−4; to an x−1th stage having a capacity about ½ the capacity of stage x.

* * * * *